US006223979B1

(12) United States Patent
Correll

(10) Patent No.: US 6,223,979 B1
(45) Date of Patent: May 1, 2001

(54) CRUSH-RESISTING PAPERBOARD CLAMSHELL CARTON

(76) Inventor: John D. Correll, 8459 Holly Dr., Canton, MI (US) 48187-4237

( * ) Notice: Subject to any disclaimer, the term of this patent is extended or adjusted under 35 U.S.C. 154(b) by 0 days.

(21) Appl. No.: 09/452,583

(22) Filed: Dec. 1, 1999

(51) Int. Cl.[7] ..... B65D 5/22

(52) U.S. Cl. ..... 229/114; 229/149; 229/154; 229/906

(58) Field of Search ..... 229/113, 114, 229/149, 154, 906, 917; 206/505, 518

(56) References Cited

U.S. PATENT DOCUMENTS

| | | | | |
|---|---|---|---|---|
| 1,681,940 | * | 8/1928 | Lander | 229/154 |
| 1,716,975 | * | 6/1929 | Phillips | 229/917 |
| 4,232,816 | * | 11/1980 | Johnson et al. | 229/149 |
| 4,877,178 | * | 10/1989 | Eisman | 229/114 |
| 4,930,681 | | 6/1990 | Fultz et al. | 229/114 |
| 4,960,238 | | 10/1990 | Lorenz | 229/125.29 |
| 5,431,333 | * | 7/1995 | Lorenz | 229/114 |
| 5,603,450 | | 2/1997 | Whitnell | 229/148 |
| 5,669,552 | | 9/1997 | Watanabe | 229/114 |
| 5,707,004 | | 1/1998 | Cai | 229/148 |
| 5,921,466 | | 7/1999 | Speese et al. | 229/114 |
| 6,065,669 | * | 5/2000 | Correll | 206/518 |
| 6,126,065 | * | 10/2000 | Wee | 229/114 |

* cited by examiner

*Primary Examiner*—Gary E. Elkins

(57) ABSTRACT

A paperboard clamshell carton having a cover member that has a distance between opposing lateral panel fold lines that is slightly longer than a distance between the top edges of opposing side walls. In addition, the height of the first and second side walls is such that the side walls extend virtually all the way from the bottom panel to the top panel of the carton. Thereby, lateral panels of the cover member are disposed on an exterior side of the side walls and the top panel rests on the top edge of the side walls, particularly when downward pressure is applied to the cover member. The invention is envisioned for use in packaging food products such as pizza, breadsticks, chicken, hamburgers, salads, and the like; however, it could be used in other applications, as well.

27 Claims, 4 Drawing Sheets

CRUSH-RESISTING PAPERBOARD CLAMSHELL CARTON

FIELD OF THE INVENTION

This invention relates to cartons made of paperboard material and, in particular, to paperboard cartons for food products such as pizza, breadsticks, chicken, hamburgers, salads, and the like.

DESCRIPTION OF THE PRIOR ART

Prior art structure can be defined in terms of one-piece versus two-piece construction. A carton of one-piece construction, called a one-piece carton, has a cover member hingedly attached to a tray member at a fold line. A carton of two-piece construction, called a two-piece carton, has separate cover and tray members. A two-piece carton typically has two problems compared to a one-piece carton. First, it's less rigid and has a less-secure cover closure, often resulting in accidental cover opening. Second, it usually requires more material to make, resulting in a more expensive carton.

Prior art structure also can be defined in terms of fixed-corner versus non-fixed-corner construction. A carton of fixed-corner construction, called a fixed-corner carton, has one or more corners formed by a fixed attachment of one wall to another. A fixed attachment between adjacent panels or walls is typically created by glue, staple, or tape. Hence, examples of cartons having one or more corners formed by a fixed attachment of one wall to another include glued-corner paperboard cartons, stapled-corner paperboard cartons, and taped-corner paperboard cartons. A carton that has no fixed attachment of one wall to another by means of glue, staple, or tape would be called a non-fixed-corner carton.

Finally, prior art can be defined in terms of clamshell versus non-clamshell construction. A carton of clamshell construction, called a clamshell carton, is a one-piece carton having a clamshell tray member hingedly attached to a clamshell cover member. As used herein, a "clamshell tray member" is defined as a bottom panel and a plurality of walls disposed obliquely to the bottom panel, with at least two of the walls being joined at a fixed corner. Similarly, as used herein, a "clamshell cover member" is defined as a top panel and a plurality of downward-angling lateral panels disposed obliquely to the top panel, with at least two of the lateral panels being joined at a fixed corner.

By definition, a clamshell carton has at least one fixed corner in the tray member and at least one fixed corner in the cover member. A "fixed corner" is defined as a corner between adjacent panels or walls resulting from a fixed attachment of one panel with the other, that fixed attachment being typically created by glue, staple, or tape. A non-fixed attachment of one wall to another is typically achieved by (a) a flap appending from one wall being enclosed between two parallel panels of an adjacent wall or (b) a flap or tab appending from one wall being enclosed within a slot or hole in an adjacent wall.

In essence, a clamshell carton is a one-piece fixed-corner carton. A two-piece carton with slanting walls is not considered to be a clamshell carton. A salient feature of clamshell cartons is that multiple units can be nested together and, when this is done, cover members nest inside cover members and tray members nest inside tray members. A carton of non-clamshell construction, called a non-clamshell carton, is a carton lacking either the clamshell tray member or the clamshell cover member or both.

Each year millions of restaurant food orders are packaged in clamshell cartons. In the current art of clamshell cartons, the side walls which project upward from the bottom panel do not extend far enough upward to reach the top panel of the cover member. Instead, each side wall extends only far enough to contact the bottom edge of a downward-angling lateral panel of the cover member. Two examples of clamshell cartons in paperboard which illustrate that structure are Fultz et al. U.S. Pat. No. 4,930,681 granted Jun. 5, 1990, and Cai U.S. Pat. No. 5,707,004 granted Jan. 13, 1998.

A main advantage of clamshell cartons is convenience; they require little or no set-up by the user.

However, current paperboard clamshell cartons have a major drawback. Specifically, they are lacking in crush resistance. When vertical downward pressure is applied to one of the lateral panels of the cover member, that vertical downward pressure is transformed into horizontal outward pressure against the top edge of the side wall that underlies the lateral panel. That horizontal outward pressure pushes the top edge of the underlying side wall outward which, in turn, results in a buckling of the entire side section of the carton.

So, there has remained a problem of how to have a paperboard clamshell carton that resists side section buckling. That problem has not been solved by the prior art but is solved by my invention. By solving that problem, a sturdier, more crush-resistant one-piece clamshell carton is provided.

In addition to the above-cited clamshell cartons, the prior art contains non-clamshell cartons having slanting side walls. Examples of such art include Lorenz U.S. Pat. No. 4,960,238 granted Oct. 2, 1990; Whitnell U.S. Pat. No. 5,603,450 granted Feb. 18, 1997; Watanabe U.S. Pat. No. 5,669,552 granted Sept. 23, 1997; and Speese et al. U.S. Pat. No. 5,921,466 granted Jul. 13, 1999.

In conclusion, it would be highly desirable to provide a paperboard clamshell carton that has greater crush resistance and, thereby, overcomes the above-described buckling problem.

OBJECT AND ADVANTAGE

Accordingly, the object of my invention is a paperboard clamshell carton that offers greater crush-resistance, or greater resistance to side section buckling, than current paperboard clamshell cartons offer. That object is accomplished by having the side walls of the tray member extend all the way from the bottom panel to the top panel of the carton, whereby the top edge of the side walls comes into contact with the top panel of the carton. With that structure, when vertical downward pressure is applied to a lateral panel of the cover member, that pressure is transferred to the underlying side wall in the form of vertical downward pressure rather than horizontal outward pressure, thereby reducing the tendency for side section buckling.

The main advantage of my invention is that, during transport, a fewer number of carry-out/delivery food orders will be destroyed by crushing.

Further objects and advantages of the invention will become apparent from consideration of the following detailed description, related drawings, and appended claims.

SUMMARY OF THE INVENTION

My invention is a paperboard clamshell carton wherein (a) the cover member has a distance between opposing lateral panel fold lines that is slightly longer than a distance between top outer edges of opposing side walls in the tray member, (b) the height of the side walls is such that the side walls extend virtually all the way from the bottom panel to the top panel of the carton, (c) a majority portion of lateral panels extending from the cover panel is disposed below the outermost perimeter of the tray member and/or (d) the rear wall is hingedly attached to the bottom panel and the top panel is hingedly attached to the rear wall.

Thereby, in the closed carton format, the lateral panels of the cover member are disposed on an exterior side of the side walls and below an outermost perimeter of the tray member, and the top panel rests on the top outer edge of the side walls, particularly when downward pressure is applied to the cover member.

The structure of my invention distinguishes from that of conventional (prior art) paperboard clamshell cartons in one or more of the following three ways. First, in a conventional paperboard clamshell carton the distance between opposing lateral panel fold lines is less than the distance between the top edges of opposing side walls. Second, in a conventional clamshell carton the side walls do not extend all the way from the bottom panel to the top panel, thereby the top panel does not contact the side walls. Third, in a conventional clamshell carton, a majority portion of the lateral panels is disposed above the outermost perimeter of the tray member.

My invention typically would be used for packaging food products such as pizza, breadsticks, chicken, hamburgers, salads, and the like; however, it could take other forms for other purposes, as well.

A complete understanding of the invention can be obtained from the detailed description that follows.

LIST OF REFERENCE NUMERALS

Figure 1:
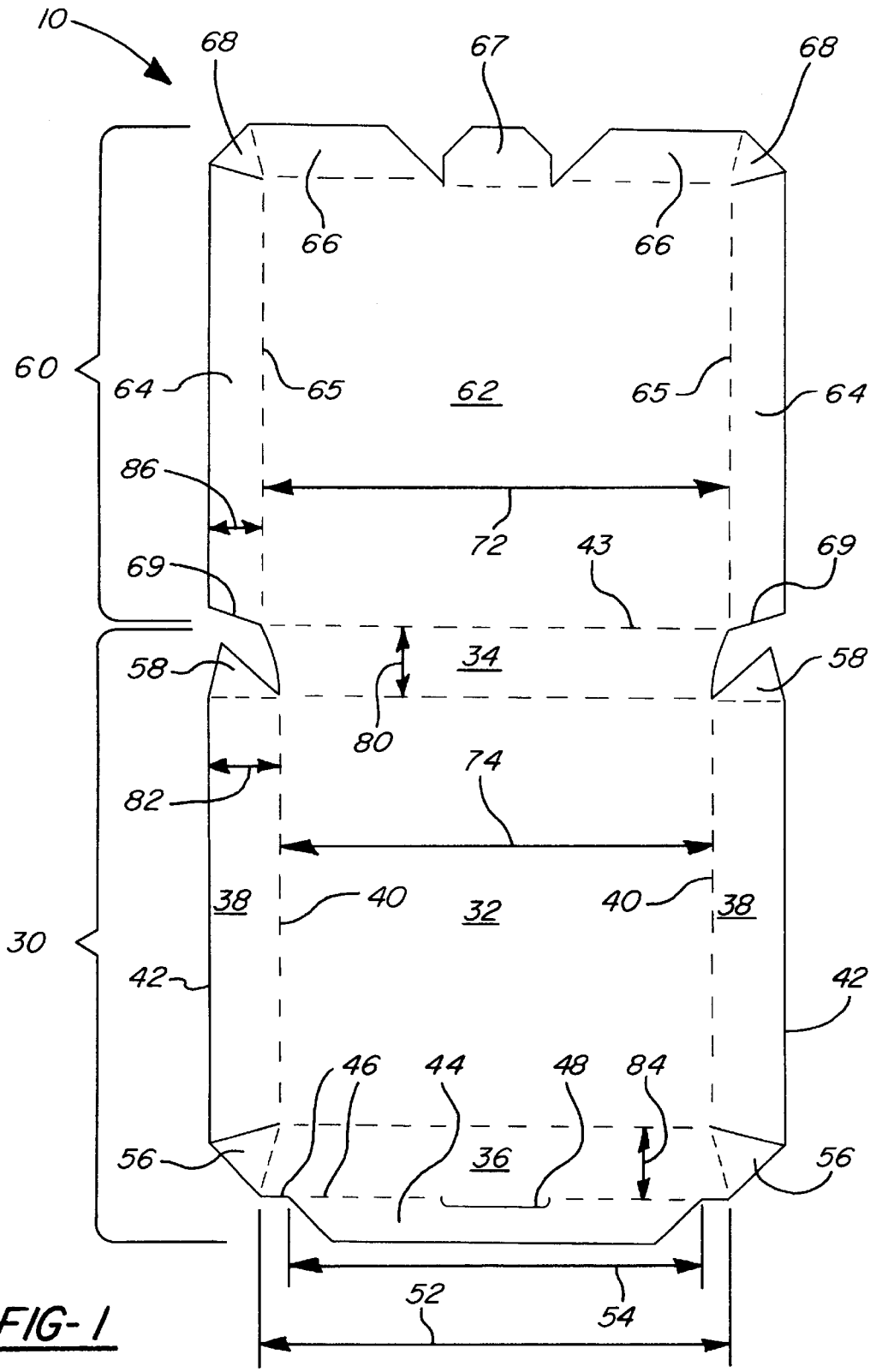
FIG. 1 is a plan view of a blank of the preferred embodiment.

Within a drawing, similar components have the same number. Between drawings, like reference numerals designate corresponding parts.

10 blank
12 carton in closed disposition
14 carton in open disposition
16 stack of nested cartons
30 clamshell tray member
32 bottom panel
34 rear wall
36 front wall
38 side wall
40 side wall fold line
42 top outer edge of side wall
43 top edge of rear wall
44 ancillary panel
46 top edge of front wall
48 cover flap receiving slot
52 length of top edge
54 length of ancillary panel
56 front corner flap
58 rear corner flap
60 clamshell cover member
62 top panel
64 lateral panel
65 lateral panel fold line
66 lateral panel
67 cover interlock flap
68 corner flap
69 rear end of lateral panel
72 distance between lateral panel fold lines
74 distance between side wall fold lines
76 distance between top edges of side walls
80 height of rear wall
82 height of side wall
84 height of front wall
86 height of lateral panel

DESCRIPTION OF THE PREFERRED EMBODIMENT

The preferred embodiment is depicted in three formats: (1) as a blank, (2) as a closed carton, and (3) as a plurality of open nested cartons. The invention is created from paperboard. The presently preferred embodiment is shown in corrugated paperboard; however, non-corrugated paperboard could be used, as well. The intended use for the embodiment is as a food carton. However, it will be appreciated, as the description proceeds, that my invention may be realized in different embodiments and used in different applications including non-food applications.

Figure 2:
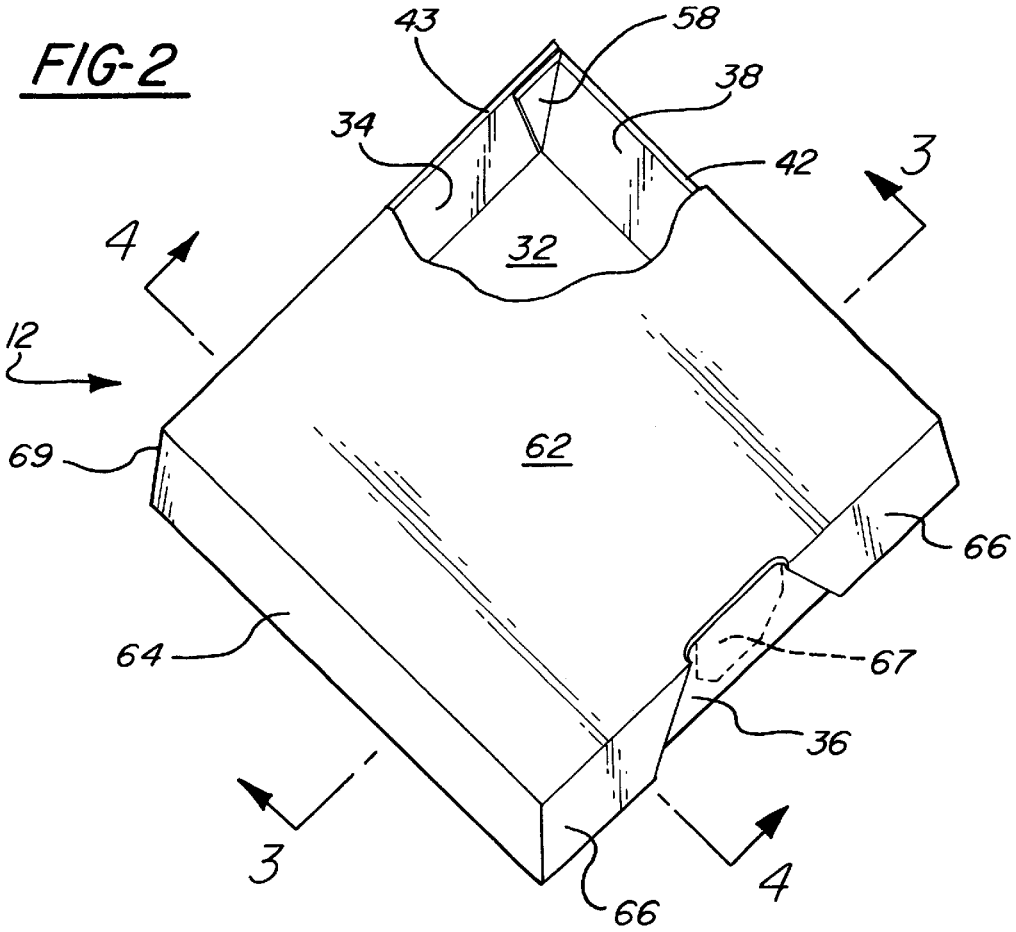
FIG. 2 is a perspective view of a closed carton formed from the blank.
Figure 5:
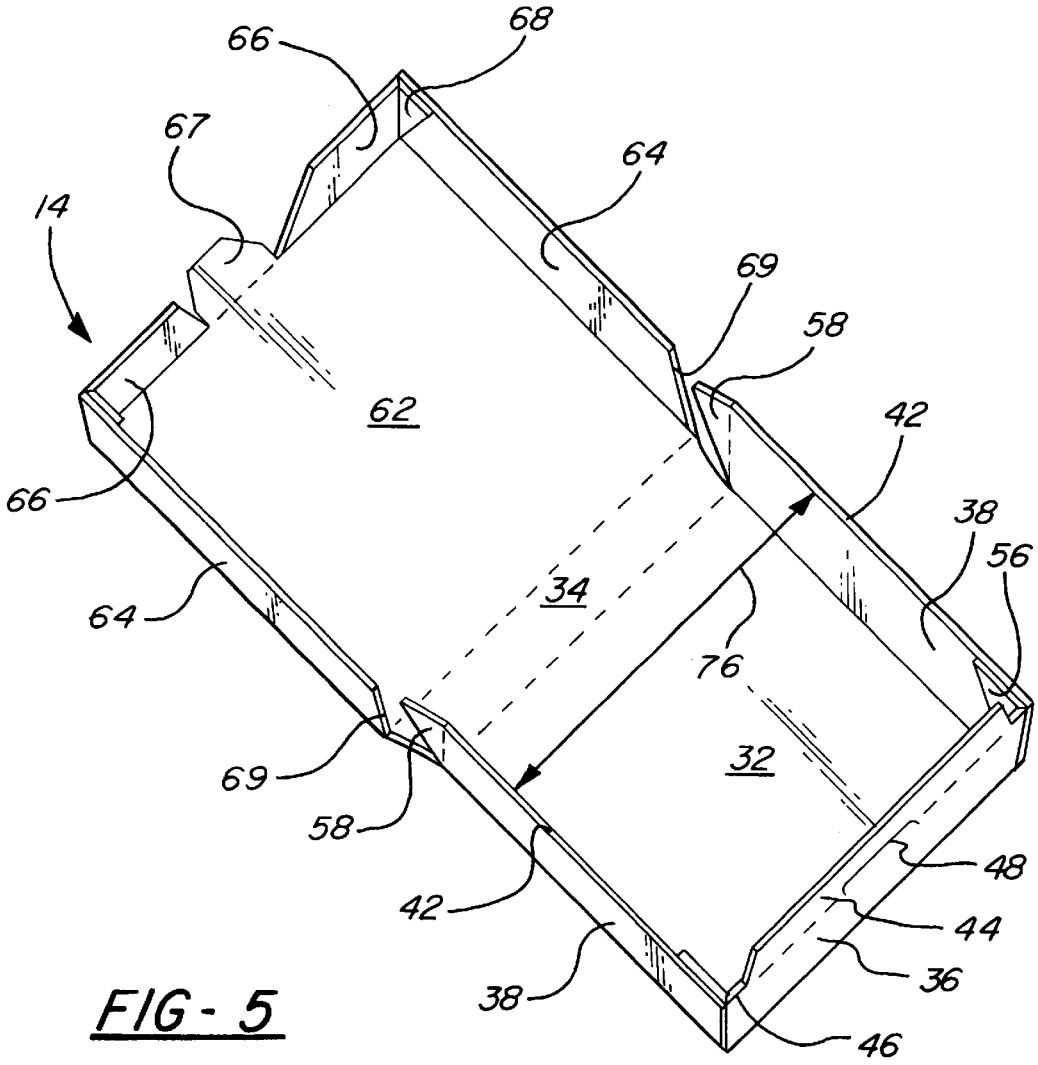
FIG. 5 is a perspective view of an open carton formed from the blank.

FIG. 1 shows a blank 10 and FIGS. 2 and 5 respectively show a carton 12 in closed disposition and a carton 14 in open disposition, both of the cartons being created from blank 10. Referenced components are labeled in FIG. 1; selected components are labeled in other Figures. Corresponding parts between drawings share a same reference numeral. It is noted that the invention is bilaterally symmetrical. Therefore, pairs of opposing like components are to be found, with one item of the pair on each side of the carton or blank. For simplicity of labeling, each component pair may be indicated by a numeral on one side of the drawing only. When this occurs, it is to be understood that the discussion also applies to the corresponding component on the other side, even though that component may not be numerically labeled.

Referring now to blank 10 shown in FIG. 1 and also to corresponding cartons 12 and 14 shown in FIGS. 2 and 5, there is a clamshell tray member 30 and a clamshell cover member 60 attached thereto.

Figure 4:
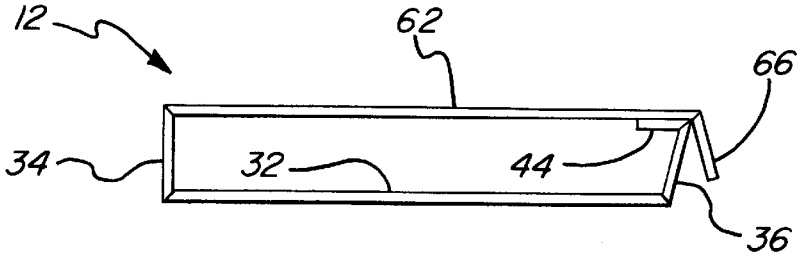
FIG. 4 is a side sectional view of the closed carton taken along line 4—4 of FIG. 2.

Clamshell tray member 30 comprises a bottom panel 32, a reclinable rear wall 34 hingedly attached at a fold line to a rear side of panel 32, a front wall 36 attached to a front side of panel 32, and a pair of opposing side walls 38 attached to left and right sides of panel 32 at a pair of side wall fold lines 40. FIG. 5, which shows a carton 14 in open disposition, shows rear wall 34 in a position coplanar to bottom panel 32, a position which is referred to as fully-reclined position. In the closed disposition, rear wall 34 is perpendicular to bottom panel 32, as shown in FIG. 4. Each side wall 38 has a top outer edge 42, rear wall 34 has a top edge 43, and front wall 36 has a top edge 46. Top outer edges 42 in combination with top edges 43 and 46 constitute the outermost perimeter of tray member 30. As used herein, an "outermost perimeter" of a tray member of a clamshell carton is defined as the outermost edge, as viewed by top view.

Further comprising tray member 30, an ancillary panel 44 is hingedly linked to top edge 46 of front wall 36 at a fold line. Disposed between front wall 36 and ancillary panel 44 is a cover flap receiving slot 48. Top edge 46 has a predetermined length 52. Ancillary panel 44 has a predetermined length 54. It is noted that length 54 is less than 95 percent of length 52. This structural arrangement allows front wall 36 to have a slight amount of flexibility in the carton format. This, in turn, facilitates easy engagement of a cover interlock flap (described subsequently) with slot 48.

The final components of tray member 30 are a pair of front corner flaps 56 attached to opposite ends of front wall 36 and a pair of rear corner flaps 58 attached to a rear end of side walls 38. In the carton format, front corner flaps 56 are glued to side walls 38, thereby creating fixed corners at the front of tray member 30. As used herein, a "fixed corner" is a corner between adjacent panels or walls resulting from a fixed attachment of one panel with the other, that fixed attachment being typically created by glue, staple, or tape.

Additionally, it is noted that rear corner flaps 58 are free-swinging. As used herein, a "frees-winging" flap or panel is defined as one that is intended to be hingedly movable when the carton is in an open disposition. Conversely, a "non-free-swinging" flap or panel is one that is intended to remain in fixed position when the carton is in open disposition. In a clamshell carton, the tray member has at least two non-free-swinging walls and the cover member has at least two non-free-swinging lateral panels.

Figure 3:
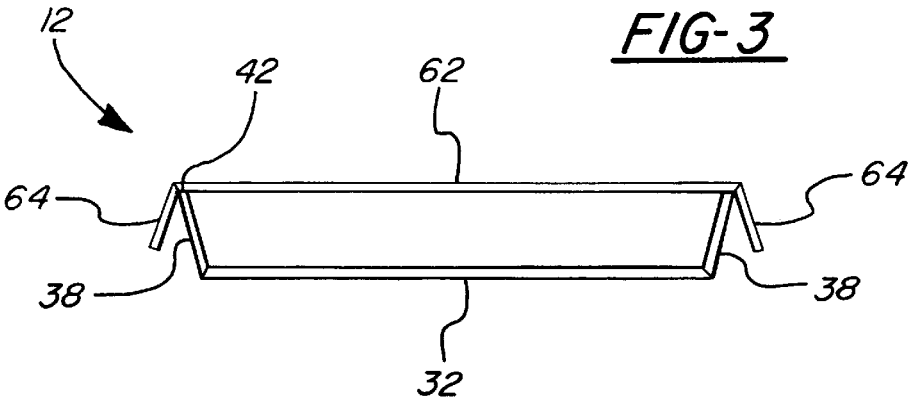
FIG. 3 is a front sectional view of the closed carton taken along line 3—3 of FIG. 2.

Clamshell cover member 60 comprises a flat top panel 62 hingedly attached at a fold line to top edge 43 of rear wall 34, a pair of opposing lateral panels 64 attached to left and right sides of panel 62 at a pair of lateral panel fold lines 65, and a pair of lateral panels 66 attached to a front side of panel 62. All of the lateral panels are non-free-swinging. Further, as shown in FIGS. 3 and 4, lateral panels 64 and 66 are disposed below the top edges of walls 36 and 38, or below the outermost perimeter of tray member 30. This structure distinguishes from that of a conventional clamshell carton in that in a conventional carton the lateral panels are largely disposed above the outermost perimeter of the tray member.

Disposed between lateral panels 66 is a free-swinging cover interlock flap 67 which fits within cover flap receiving slot 48 when the carton is in closed disposition. A corner flap 68 is attached to a front end of each lateral panel 66. In the carton format, corner flaps 68 are glued to lateral panels 64, thereby creating fixed corners at the front of cover member 60. Each of lateral panels 64 has a rear end 69. It is noted that rear end 69 is free of attachment, or free of connection to any other panel of the carton.

Critical to the invention is the relationship between three key dimensions. Referring to FIG. 1, the first key dimension is a dimension 72 which is the distance between lateral panel fold lines 65. The second key dimension is a dimension 74 which is the distance between side wall fold lines 40. And the third key dimension is a dimension 76 which is the distance between top outer edges 42 of side walls 38, as shown in the carton of FIG. 5. It is noted that dimension 72 is slightly longer than dimensions 74 and 76. This structure distinguishes from that of a conventional clamshell carton in that in a conventional carton dimension 72 is shorter than dimension 76 and usually equal to dimension 74. This is illustrated in Fultz et al. U.S. Pat. No. 4,930,681 and Cai U.S. Pat. No. 5,707,004.

Because dimension 72 is longer than dimension 76, lateral panels 64 can be disposed on an exterior side of side walls 38 and top panel 62 can come into contact with top outer edge 42 of the side walls, as shown in FIG. 3. This structure distinguishes from that of a conventional clamshell carton in that in a conventional carton the top panel never comes into contact with the top outer edge of the side walls and the lateral panels are disposed above the side walls, as illustrated in Fultz et al. and Cai patents.

Referring to FIG. 1, rear wall 34 has a height 80, side walls 38 have a height 82, front wall 36 has a height 84, and lateral panels 64 have a height 86. It is noted that heights 80, 82, and 84 are substantially equal and that all three of those heights are substantially longer than height 86. This structure distinguishes from that of a conventional paperboard clamshell carton in that in a conventional carton height 82 is usually equal to or less than height 86 and height 84 is often greater than heights 82 and 80, as can be seen in Fultz et al. and Cai.

Finally, it is noted that rear wall 34 extends all the way from bottom panel 32 to top panel 62. This structure distinguishes from that of a conventional paperboard clamshell carton in that in a conventional carton the rear wall does not extend all the way to the top panel but, instead, joins the cover member at a lateral panel attached to a rear edge of the top panel.

In the preferred embodiment, top panel 62 is intended to contact top outer edge 42 of side walls 38 when the carton is in closed disposition. However, it is possible, either due to inadvertent material warpage or by intentional design, for top panel 62 to be disposed slightly above top outer edges 42 when the carton is in non-use but to come into contact with top outer edges 42 when slight downward pressure is applied to cover member 60. Although not suggested as the preferred embodiment, this structural arrangement is regarded as being within the scope of the invention.

To convert the carton from open disposition to closed disposition, push ancillary panel 44 downward until it is approximately perpendicular to front wall 36. Then fold rear corner flaps 58 inward. Finally, pull cover member 60 forward, tucking cover interlock flap 67 into flap receiving slot 48.

Figure 6:
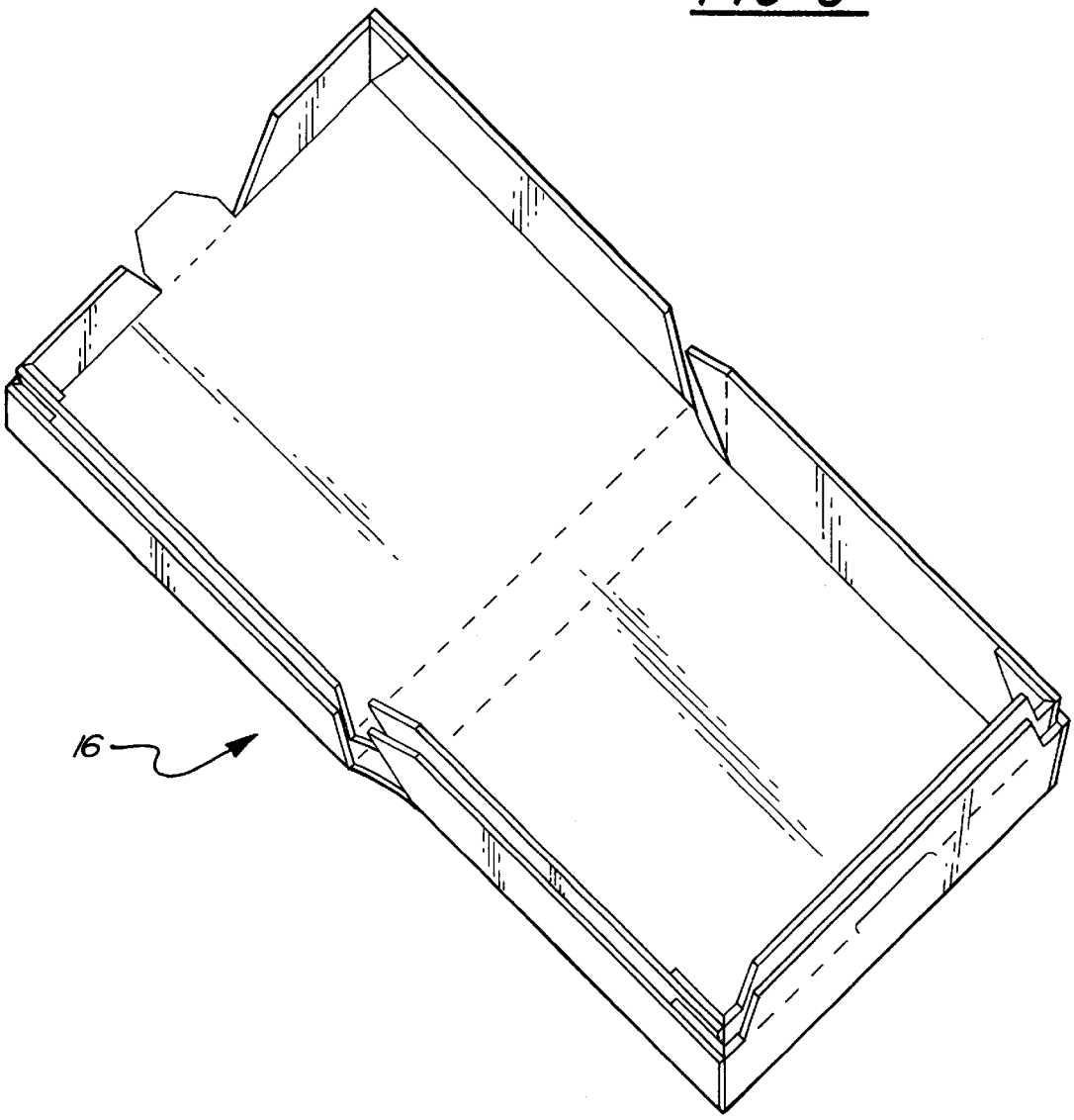
FIG. 6 is a perspective view of a stack of nested open cartons.

For space savings in shipping and storage, multiple units of open carton 14 are nested together into a stack 16, as shown in FIG. 6.

Within the context of this invention, a fold line can be created by a number of means such as, for example, by a crease or score in the board, by a series of aligned spaced short slits in the board, and by a combination of aligned spaced short and long slits. In some cases, when a longer slit is bounded on the ends by a series of shorter slits or a score, the longer slit may be slightly offset in alignment from the shorter slits or score for the purpose of creating a slot along the fold line when the blank is set up into a carton. Such an offset slit may be referred to herein as a "slot-forming slit." Nonetheless, the entire combination of long and short slits is considered to constitute a single fold line unless otherwise indicated.

In conclusion, as referred to herein, a fold line is any line between two points on the blank or box along which the board is intended to be folded when the blank is being erected into a carton. The type of fold lines shown in the drawings are presently preferred but it will be appreciated that other methods known to those skilled in the art may be used.

CONCLUSION, RAMIFICATIONS, AND SCOPE

I have disclosed a paperboard clamshell carton wherein (a) the distance between the lateral panel fold lines is slightly longer than the distance between the top outer edges of the first and second side walls, (b) the height of the first and second side walls is such that the side walls extend virtually all the way from the bottom panel to the top panel of the carton, and (c) a majority portion of the lateral panels is disposed below the outermost perimeter of the tray member.

Thereby, the first and second lateral panels of the cover member are disposed below the outermost perimeter of the tray member and on an exterior side of the side walls and the top panel rests on the top outer edge of the side walls when slight downward pressure is applied to the cover member.

The main advantage of my invention is enhanced crush-resistance which results in reduced side section buckling during usage.

The illustrated number, size, shape, type, and placement of components represent the preferred embodiment; however, many other combinations and configurations are possible within the scope of the invention.

The foregoing discussion has pertained mainly to packaging food products such as pizza, breadsticks, chicken, hamburgers, salads, and the like. However, it should be realized that my invention could be used for other purposes, as well. In conclusion, it is understood that the invention is not to be limited to the disclosed embodiment but, on the contrary, is intended to cover various modifications and equivalent arrangements included within the spirit and scope of the appended claims, which scope is to be accorded the broadest interpretation so as to encompass all such modifications and equivalent structures as is permitted under the law.

I claim:

1. First and second paperboard clamshell cartons each being in an open disposition, the first carton being nested inside the second carton and each of the cartons comprising:

a clamshell tray member comprising a bottom panel, opposing front and rear walls, and opposing first and second side walls disposed obliquely to said bottom panel and having a top outer edge, a predetermined minimum distance existing between the top outer edge of said first side wall and the top outer edge of said second side wall, a clamshell cover member comprising a top panel and opposing non-free-swinging first and second lateral panels disposed obliquely to said top panel and attached thereto at respective first and second lateral panel fold lines, a predetermined maximum distance existing between said first and second lateral panel fold lines;

wherein:

(a) the predetermined maximum distance between said first and second lateral panel fold lines is slightly longer than the predetermined minimum distance between the top outer edge of said first side wall and the top outer edge of said second side wall, and (b) said rear wall is hingedly attached to said bottom panel and said top panel is hingedly attached to said rear wall and both said rear wall and said top panel are free-swinging.

2. The first and second cartons of claim 1, wherein in each of the cartons:

said rear wall is disposed substantially coplanar to at least one of said bottom panel and said top panel.

3. The first and second cartons of claim 1, wherein in each of the cartons:

each of said front wall and said first and second side walls has a predetermined height, the predetermined height of each of said first and second side walls is substantially equal to the predetermined height of said front wall.

4. The first and second cartons of claim 1, wherein in each of the cartons:

each of said first and second lateral panels has a rear end and each said rear end is free of a fixed-corner attachment.

5. The first and second cartons of claim 1, wherein in each of the cartons:

said clamshell tray member further comprises first and second rear corner flaps hingedly attached to said first and second side walls, respectively, each of the rear corner flaps being free-swinging.

6. The first and second cartons of claim 1, wherein in each of the cartons:

said clamshell tray member further comprises an ancillary panel hingedly attached to a top edge of said front wall.

7. The first and second cartons of claim 1, wherein in each of the cartons:

said clamshell cover member further comprises (a) third and fourth lateral panels attached to said top panel and disposed obliquely thereto and (b) a free-swinging cover interlock flap hingedly attached to said top panel and disposed between said third and fourth lateral panels.

8. The first and second cartons of claim 1, wherein in each of the cartons:

each of said first and second side walls has a predetermined height and each of said first and second lateral panels has a predetermined height, the predetermined height of each of the side walls is substantially longer than the predetermined height of each of the lateral panels.

9. First and second paperboard clamshell cartons each being in an open disposition, the first carton being nested inside the second carton and each of the cartons comprising:

a clamshell tray member comprising a bottom panel, opposing front and rear walls, and opposing first and second side walls disposed obliquely to said bottom panel and having a top outer edge, a predetermined minimum distance existing between the top outer edge of said first side wall and the top outer edge of said second side wall, a clamshell cover member comprising a top panel hingedly attached to a top edge of said rear wall and opposing non-free-swinging first and second lateral panels disposed obliquely to said top panel and attached thereto at respective first and second lateral panel fold lines, a predetermined maximum distance existing between said first and second lateral panel fold lines;

wherein:

(a) the predetermined maximum distance between said first and second lateral panel fold lines is slightly longer than the predetermined minimum distance between the top outer edge of said first side wall and the top outer edge of said second side wall, and (b) each of said first and second lateral panels has a rear end and each said rear end is free of a fixed-corner attachment.

10. The first and second cartons of claim 9, wherein in each of the cartons:

said rear wall is disposed substantially coplanar to at least one of said bottom panel and said top panel.

11. The first and second cartons of claim 9, wherein in each of the cartons:

each of said front wall and said first and second side walls has a predetermined height, the predetermined height of each of said first and second side walls is substantially equal to the predetermined height of said front wall.

12. The first and second cartons of claim 9, wherein in each of the cartons:

said clamshell tray member further comprises first and second rear corner flaps hingedly attached to said first and second side walls, respectively, each of the rear corner flaps being free-swinging.

13. The first and second cartons of claim 9, wherein in each of the cartons:

said clamshell tray member further comprises an ancillary panel hingedly attached to a top edge of said front wall.

14. The first and second cartons of claim 9, wherein in each of the cartons:

said clamshell cover member further comprises (a) third and fourth lateral panels attached to said top panel and disposed obliquely thereto and (b) a free-swinging cover interlock flap hingedly attached to said top panel and disposed between said third and fourth lateral panels.

15. The first and second cartons of claim 9, wherein in each of the cartons:

each of said first and second side walls has a predetermined height and each of said first and second lateral panels has a predetermined height, the predetermined height of each of the side walls is substantially longer than the predetermined height of each of the lateral panels.

16. A paperboard clamshell carton in closed disposition and comprising:

a clamshell tray member comprising a bottom panel, opposing front and rear walls, and opposing first and second side walls disposed obliquely to said bottom panel and having a top outer edge, a predetermined distance existing between the top outer edge of said first side wall and the top outer edge of said second side wall, each of the walls having a predetermined height, a clamshell cover member hingedly attached to a top edge of said rear wall and comprising a top panel and opposing non-free-swinging first and second lateral panels disposed obliquely to said top panel and attached thereto at respective first and second lateral panel fold lines, a predetermined distance existing between said first and second lateral panel fold lines, each of the lateral panels having a predetermined height;

wherein:

(a) the predetermined distance between said first and second lateral panel fold lines is slightly longer than the predetermined distance between the top outer edge of said first side wall and the top outer edge of said second side wall, and (b) at least a portion of the top outer edge of at least one of the first and second side walls is in contact with said top panel when slight downward pressure is applied to said clamshell cover member, and (c) a majority portion of each of said first and second lateral panels is disposed below an outermost perimeter of said clamshell tray member, and (d) the predetermined height of each of said first and second side walls is longer than the predetermined height of each of said first and second lateral panels.

17. The carton of claim 16 wherein:

said rear wall extends between said bottom panel and said top panel.

18. The carton of claim 16 wherein:

each of said first and second lateral panels has a rear end and each said rear end is free of a fixed-corner attachment.

19. The carton of claim 16 wherein:

said rear wall is hingedly attached to said bottom panel and said top panel is hingedly attached to said rear wall and both said rear wall and said top panel are hingedly movable.

20. The carton of claim 16 wherein:

said rear wall is disposed substantially perpendicular to said bottom panel.

21. The carton of claim 16 wherein:

the predetermined height of each of said first and second side walls is substantially equal to the predetermined height of said front wall.

22. The carton of claim 16 wherein:

said clamshell tray member further comprises first and second rear corner flaps hingedly attached to said first and second side walls, respectively, each of the rear corner flaps being hingedly movable.

23. The carton of claim 16 wherein:

said clamshell tray member further comprises an ancillary panel hingedly attached to a top edge of said front wall and disposed substantially parallel to said top panel.

24. The carton of claim 16 wherein:

said clamshell cover member further comprises (a) third and fourth lateral panels attached to said top panel and disposed obliquely thereto and (b) a free-swinging cover interlock flap hingedly attached to said top panel and disposed between said third and fourth lateral panels.

25. A paperboard clamshell carton in open disposition and comprising:

a clamshell tray member comprising a bottom panel, opposing front and rear walls, and opposing first and second side walls disposed obliquely to said bottom panel, a clamshell cover member comprising a top panel and opposing non-free-swinging first and second lateral panels disposed obliquely to said top panel;

wherein:

(a) said top panel is hingedly movable at a fold line joining said top panel to said rear wall, and (b) said rear wall is hingedly movable at a fold line joining said rear wall to said bottom panel;

whereby when said paperboard clamshell carton is disposed on a flat surface said rear wall can assume a disposition coplanar to both said top panel and said bottom panel.

26. The carton of claim 25 wherein:

each of said first and second lateral panels has a rear end and each said rear end is free of a fixed-corner attachment.

27. The carton of claim 26 wherein:

said clamshell tray member further comprises first and second rear corner flaps hingedly attached to said first and second side walls, respectively, each of the rear corner flaps being hingedly movable.

* * * * *